US009865926B2

(12) United States Patent
Ganchrow

(10) Patent No.: US 9,865,926 B2
(45) Date of Patent: Jan. 9, 2018

(54) LOW ANGLE RADIATING SHORTED HALF PATCH ANTENNA

(71) Applicant: QUALCOMM Incorporated, San Diego, CA (US)

(72) Inventor: Elimelech Ganchrow, Zichron Yaakov (IL)

(73) Assignee: QUALCOMM Incorporated, San Diego, CA (US)

( * ) Notice: Subject to any disclaimer, the term of this patent is extended or adjusted under 35 U.S.C. 154(b) by 7 days.

(21) Appl. No.: 14/843,733

(22) Filed: Sep. 2, 2015

(65) Prior Publication Data

US 2017/0062935 A1 Mar. 2, 2017

(51) Int. Cl.
*H01Q 9/04* (2006.01)
*H01Q 1/48* (2006.01)

(52) U.S. Cl.
CPC ..... *H01Q 9/0414* (2013.01); *H01Q 9/0421* (2013.01); *H01Q 1/48* (2013.01)

(58) Field of Classification Search
CPC ..... H01Q 9/0421; H01Q 9/0414
See application file for complete search history.

(56) References Cited

U.S. PATENT DOCUMENTS 4,078,237 A * 3/1978 Kaloi ..... H01Q 9/0421 343/700 MS
5,801,660 A * 9/1998 Ohtsuka ..... H01Q 9/0414 343/700 MS (Continued)

FOREIGN PATENT DOCUMENTS

WO 2007141505 A1 12/2007

OTHER PUBLICATIONS

He J-W., et al., "Design Considerations of Planar Inverted-F Antenna (PIFA) on a Finite Ground Plane", The 2004 Joint Conference of the 10th Asia-Pacific Conference on Communications, 2004 and the 5th International Symposium on Multi-Dimensional Mobile Communications Proceedings, XP010765043, Aug. 29, 2004, vol. 2, pp. 655-659, DOI: 10.1109/APCC.2004.1391797.

(Continued)

*Primary Examiner* — Tho G Phan
*Assistant Examiner* — Patrick Holecek
(74) *Attorney, Agent, or Firm* — Loza & Loza, LLP/Qualcomm

(57) ABSTRACT

An antenna and methods of assembling the same are provided. The antenna includes a radiating element having front and rear edges and a grounding element positioned substantially parallel to and below the radiating element. The antenna also includes at least one shorting element coupling the rear edge of the radiating element to the grounding element. In the antenna, a length of the radiating element from the front to rear edges is approximately one quarter of a wavelength for a frequency the radio band of operation. Further, an a lateral distance from the front edge of the radiating element to a corresponding edge of the grounding element are less than or equal to approximately one half of the wavelength and a lateral distance from the rear edge of the radiating element to a corresponding edge of the grounding element is greater than or equal to approximately one half of the wavelength.

8 Claims, 11 Drawing Sheets

(56) References Cited

U.S. PATENT DOCUMENTS

| | | | | |
|---|---|---|---|---|
| 6,452,558 | B1 * | 9/2002 | Saitou | H01Q 1/362 343/700 MS |
| 8,547,187 | B2 | 10/2013 | Pao et al. | |
| 2007/0057847 | A1 | 3/2007 | Tsai et al. | |
| 2012/0212384 | A1 | 8/2012 | Kam et al. | |
| 2012/0235875 | A1 | 9/2012 | Hung et al. | |
| 2012/0299778 | A1 | 11/2012 | Yen et al. | |
| 2015/0069134 | A1 | 3/2015 | Westrick | |

OTHER PUBLICATIONS

International Search Report and Written Opinion—PCT/US2016/045190—ISA/EPO—dated Oct. 18, 2016.

Wong K.L., "Compact and Broadband Microstrip Antennas," Chapter 2: Compact Microstrip Antennas, 2002, pp. 22-44.

* cited by examiner

LOW ANGLE RADIATING SHORTED HALF PATCH ANTENNA

FIELD

Aspects of the present disclosure relate generally to patch antenna circuits for communications devices, and more particularly, to shorted half patch antenna designs for enhanced low angle radiation performance.

BACKGROUND

Communications using the 60 GHz band are of particular interest for providing short-range, high throughput data links for electronic consumer devices. To support such communications in many types of electronic consumer devices, low profile and low area antennas are required that can radiate is all possible directions, including forward or low angle directions. One method for providing antennas in consumer devices to support low angle radiation is using a printed dipole antenna on the edge of a printed circuit board (PCB). This method creates radiation that is polarized parallel to the PCB it is printed on. However, this approach has drawbacks due to the nature of dipole antennas. In particular, a dipole antenna behaves like a resonant circuit that has a series inductor and shunt capacitor. Therefore, if there are too many other conductive elements on the PCB in the vicinity of the dipole, the capacitance may become too large and the bandwidth of the antenna can suffer. Moreover, reducing the number of such other conductive elements in the vicinity of the dipole antenna is difficult, as modern PCB designs typically require a high circuit density for costs and/or size purposes. Therefore, keeping the necessary clearances for the dipole antenna to work properly is difficult. Another method for providing low angle radiation antennas in PCBs are closed cavity backed slot antennas. However, while closed cavity backed slot antennas are less sensitive to proximity issues than dipole antennas, the presence of the cavity makes closed cavity backed slot antennas more difficult to tune over the bandwidth required for 60 GHZ (14%).

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

An aspect of the present disclosure involves an apparatus for wireless communications. The apparatus includes a grounding element, a radiating element above the grounding element and having opposing front and rear edges, and at least one shorting element coupling the grounding element to a portion of the radiating element adjacent to the rear edge of the radiating element. In the apparatus, a length of the radiating element from the front edge to the rear edge is equal to approximately one quarter of a wavelength for a frequency within a radio band for operating the apparatus, a lateral distance from the front edge of the radiating element to a corresponding edge of the grounding element are less than or equal to approximately one half of the wavelength, and a lateral distance from the rear edge of the radiating element to a corresponding edge of the grounding element is greater than or equal to approximately one half of the wavelength.

Another aspect of the present disclosure involves an apparatus for wireless communications. The apparatus includes a grounding element, a radiating element above the grounding element and having opposing front and rear edges, means for coupling the grounding element to a portion of the radiating element adjacent to the rear edge of the radiating element, and means for feeding the radiating element. In the apparatus, a length of the radiating element from the front edge to the rear edge is equal to approximately one quarter of a wavelength for a frequency within a radio band for operating the apparatus, a lateral distance from the front edge of the radiating element to a corresponding edge of the grounding element are less than or equal to approximately one half of the wavelength, and a lateral distance from the rear edge of the radiating element to a corresponding edge of the grounding element is greater than or equal to approximately one half of the wavelength.

Another aspect of the present disclosure involves a method of manufacturing an apparatus for wireless communication. The method includes providing a substrate, forming a grounding element on the substrate, forming a radiating element above the grounding element with opposing front and rear edges, and coupling the grounding element to a portion of the radiating element adjacent to the rear edge of the radiating element via at least one shorting element. In the method, a length of the radiating element from the front edge to the rear edge is selected to be equal to approximately one quarter of a wavelength for a frequency within a radio band for operating the apparatus, a lateral distance from the front edge of the radiating element to a corresponding edge of the grounding element is selected to be less than or equal to approximately one half of the wavelength, and a lateral distance from the rear edge of the radiating element to a corresponding edge of the grounding element is selected to be greater than or equal to approximately one half of the wavelength.

Another aspect of the present disclosure involves a wireless station. The wireless station includes at least one antenna having a grounding element, a radiating element above the grounding element and having opposing front and rear edges, and at least one shorting element coupling the grounding element to a portion of the radiating element adjacent to the rear edge of the radiating element. The wireless station also includes a receiver configured to receive, via the at least one antenna, signals transmitted in a network and a processing system configured to determine, based on the signals, information transmitted in the network. In the wireless station, a length of the radiating element from the front edge to the rear edge is equal to approximately one quarter of a wavelength for a frequency within a radio band for operating the apparatus, a lateral distance from the front edge of the radiating element to a corresponding edge of the grounding element are less than or equal to approximately one half of the wavelength, and a lateral distance from the rear edge of the radiating element to a corresponding edge of the grounding element is greater than or equal to approximately one half of the wavelength.

Another aspect of the present disclosure involves an access point. The access point includes at least one antenna having a grounding element, a radiating element above the grounding element and having opposing front and rear edges, and at least one shorting element coupling the grounding element to a portion of the radiating element adjacent to the rear edge of the radiating element. The access point also includes a processing system configured to generate signals corresponding to information for transmission in a network and a transmitter configured to transmit, via the at least one antenna, the signals for transmission in the network. In the access point, a length of the radiating element from the front edge to the rear edge is equal to approximately one quarter of a wavelength for a frequency within a radio band for operating the apparatus, a lateral distance from the front edge of the radiating element to a corresponding edge of the grounding element are less than or equal to approximately one half of the wavelength, and a lateral distance from the rear edge of the radiating element to a corresponding edge of the grounding element is greater than or equal to approximately one half of the wavelength.

To the accomplishment of the foregoing and related ends, the one or more embodiments comprise the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

DETAILED DESCRIPTION

Figure 1:
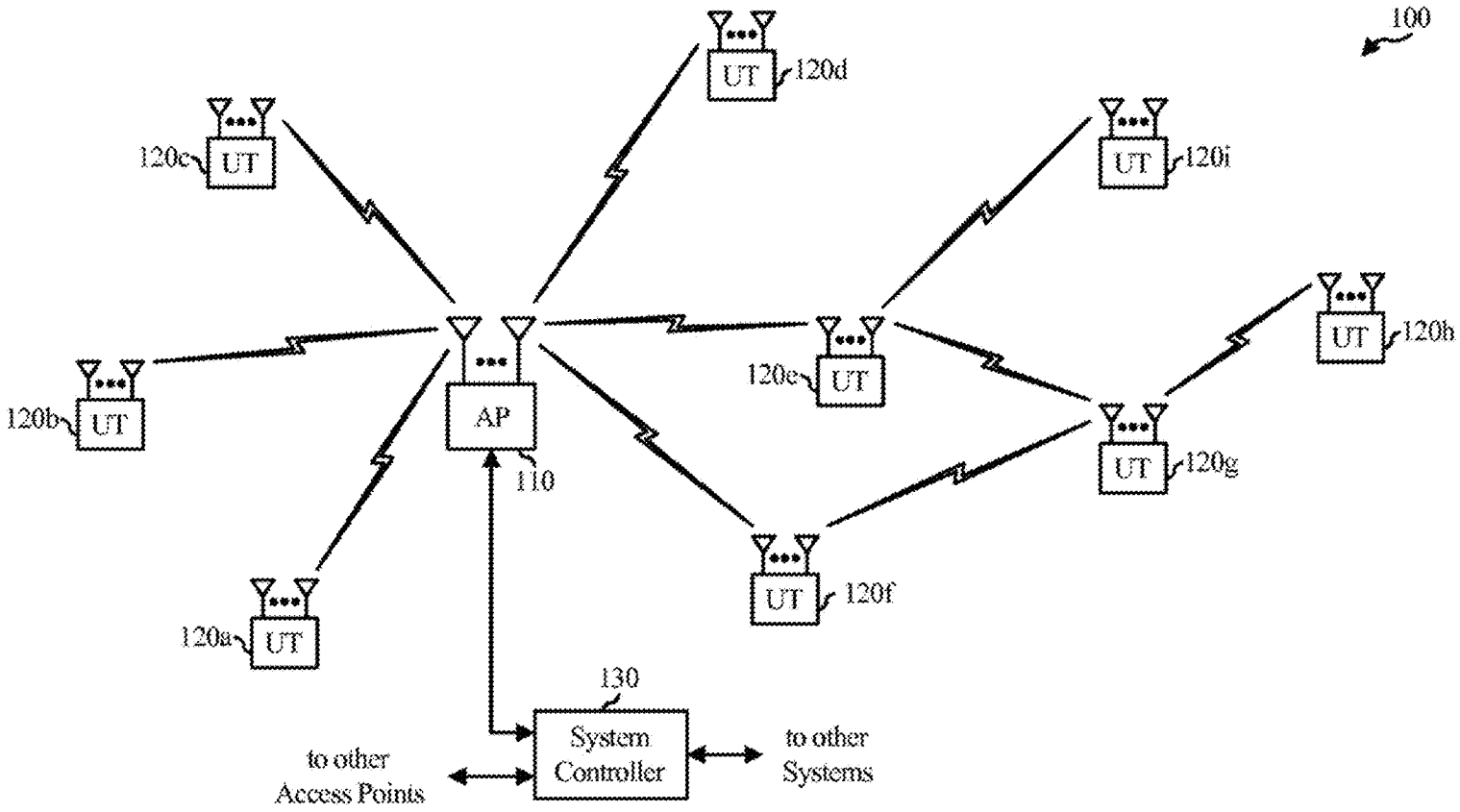
FIG. 1 illustrates a diagram of an example wireless communications network, in accordance with certain aspects of the present disclosure.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The present disclosure is related to an antenna array design for Access Point (AP) devices and other similar devices, as shown below. For convenience, this improved patch antenna design will be described in the context of an AP device implementation of this antenna design. However, it is understood that techniques described herein may have other applications, as will be explained further below.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different wireless technologies, system configurations, networks, and transmission protocols, some of which are illustrated by way of example in the figures and in the following description of the preferred aspects. The detailed description and drawings are merely illustrative of the disclosure rather than limiting and the scope of the disclosure is being defined by the appended claims and equivalents thereof.

The teachings herein may be incorporated into (e.g., implemented within or performed by) a variety of wired or wireless apparatuses (e.g., nodes). In some aspects, a wireless node implemented in accordance with the teachings herein may comprise an access point or an access terminal. A wireless node may provide, for example, connectivity for or to a network (e.g., a wide area network such as the Internet or a cellular network) via a wired or wireless communication link.

An access point ("AP") may comprise, be implemented as, or known as a Node B, Radio Network Controller ("RNC"), evolved Node B (eNB), Base Station Controller ("BSC"), Base Transceiver Station ("BTS"), Base Station ("BS"), Transceiver Function ("TF"), Radio Router, Radio Transceiver, Basic Service Set ("BSS"), Extended Service Set ("ESS"), Radio Base Station ("RBS"), or some other terminology.

An access terminal ("AT") may comprise, be implemented as, or known as a subscriber station, a subscriber unit, a mobile station (MS), a remote station, a remote terminal, a user terminal (UT), a user agent, a user device, user equipment (UE), a user station, or some other terminology. In some implementations, an access terminal may comprise a cellular telephone, a cordless telephone, a Session Initiation Protocol ("SIP") phone, a wireless local loop ("WLL") station, a personal digital assistant ("PDA"), a handheld device having wireless connection capability, a Station ("STA"), or some other suitable processing device coupled to a wireless modem. Accordingly, one or more aspects taught herein may be incorporated into a phone (e.g., a cellular phone or smart phone), a computer (e.g., a laptop), a tablet, a portable communication device, a portable computing device (e.g., a personal data assistant), an entertainment device (e.g., a music or video device, or a satellite radio), a global positioning system (GPS) device, or any other suitable device that is configured to communicate via a wireless or wired medium.

An Example Wireless Communication System

The techniques described herein may be used for various broadband wireless communication systems, including communication systems that are based on an orthogonal multiplexing scheme. Examples of such communication systems include Spatial Division Multiple Access (SDMA) system, Time Division Multiple Access (TDMA) system, Orthogonal Frequency Division Multiple Access (OFDMA) system and Single-Carrier Frequency Division Multiple Access (SC-FDMA) systems. An SDMA system may utilize sufficiently different directions to simultaneously transmit data belonging to multiple user terminals. A TDMA system may allow multiple user terminals to share the same frequency channel by dividing the transmission signal into different time slots, each time slot being assigned to different user terminal. An OFDMA system utilizes orthogonal frequency division multiplexing (OFDM), which is a modulation technique that partitions the overall system bandwidth into multiple orthogonal sub-carriers. These sub-carriers may also be called tones, bins, etc. With OFDM, each sub-carrier may be independently modulated with data. An SC-FDMA system may utilize interleaved FDMA (IFDMA) to transmit on sub-carriers that are distributed across the system bandwidth, localized FDMA (LFDMA) to transmit on a block of adjacent sub-carriers, or enhanced FDMA (EFDMA) to transmit on multiple blocks of adjacent sub-carriers. In general, modulation symbols are sent in the frequency domain with OFDM and in the time domain with SC-FDMA.

The teachings herein may be incorporated into (e.g., implemented within or performed by) a variety of wired or wireless apparatuses (e.g., nodes). In some aspects, a wireless node implemented in accordance with the teachings herein may comprise an access point or an access terminal. A wireless node may provide, for example, connectivity for or to a network (e.g., a wide area network such as the Internet or a cellular network) via a wired or wireless communication link.

An access point ("AP") may comprise, be implemented as, or known as a Node B, Radio Network Controller ("RNC"), evolved Node B (eNB), Base Station Controller ("BSC"), Base Transceiver Station ("BTS"), Base Station ("BS"), Transceiver Function ("TF"), Radio Router, Radio Transceiver, Basic Service Set ("BSS"), Extended Service Set ("ESS"), Radio Base Station ("RBS"), or some other terminology.

An access terminal ("AT") may comprise, be implemented as, or known as a subscriber station, a subscriber unit, a mobile station (MS), a remote station, a remote terminal, a user terminal (UT), a user agent, a user device, user equipment (UE), a user station, or some other terminology. In some implementations, an access terminal may comprise a cellular telephone, a cordless telephone, a Session Initiation Protocol ("SIP") phone, a wireless local loop ("WLL") station, a personal digital assistant ("PDA"), a handheld device having wireless connection capability, a Station ("STA"), or some other suitable processing device coupled to a wireless modem. Accordingly, one or more aspects taught herein may be incorporated into a phone (e.g., a cellular phone or smart phone), a computer (e.g., a laptop), a tablet, a portable communication device, a portable computing device (e.g., a personal data assistant), an entertainment device (e.g., a music or video device, or a satellite radio), a global positioning system (GPS) device, or any other suitable device that is configured to communicate via a wireless or wired medium.

FIG. 1 illustrates an example wireless communication system in which aspects of the present disclosure may be practiced. For example, AP 110 may be configured to generate and transmit a frame having one or more bits that indicate both minimum and maximum bandwidths for communicating in a network. UT 120 may be configured to obtain (e.g., receive) the frame and determine, based on the one or more bits in the frame, both the minimum and maximum bandwidths for communicating in the network.

FIG. 1 illustrates a multiple-access multiple-input multiple-output (MIMO) system 100 with access points and user terminals. For simplicity, only one access point 110 is shown in FIG. 1. An access point is generally a fixed station that communicates with the user terminals and may also be referred to as a base station or some other terminology. A user terminal may be fixed or mobile and may also be referred to as a mobile station, a wireless device, a user equipment, or some other terminology. Access point 110 may communicate with one or more user terminals 120 at any given moment on the downlink and uplink. The downlink (i.e., forward link) is the communication link from the access point to the user terminals, and the uplink (i.e., reverse link) is the communication link from the user terminals to the access point. A user terminal may also communicate peer-to-peer with another user terminal.

A system controller 130 may provide coordination and control for these APs and/or other systems. The APs may be managed by the system controller 130, for example, which may handle adjustments to radio frequency power, channels, authentication, and security. The system controller 130 may communicate with the APs via a backhaul. The APs may also communicate with one another, e.g., directly or indirectly via a wireless or wireline backhaul.

While portions of the following disclosure will describe user terminals 120 capable of communicating via Spatial Division Multiple Access (SDMA), for certain aspects, the user terminals 120 may also include some user terminals that do not support SDMA. Thus, for such aspects, an AP 110 may be configured to communicate with both SDMA and non-SDMA user terminals. This approach may conveniently allow older versions of user terminals ("legacy" stations) to remain deployed in an enterprise, extending their useful lifetime, while allowing newer SDMA user terminals to be introduced as deemed appropriate.

The system 100 employs multiple transmit and multiple receive antennas for data transmission on the downlink and uplink. The access point 110 is equipped with $N_{ap}$ antennas and represents the multiple-input (MI) for downlink transmissions and the multiple-output (MO) for uplink transmissions. A set of K selected user terminals 120 collectively represents the multiple-output for downlink transmissions and the multiple-input for uplink transmissions. For pure SDMA, it is desired to have $N_{ap} \geq K \geq 1$ if the data symbol streams for the K user terminals are not multiplexed in code, frequency or time by some means. K may be greater than $N_{ap}$ if the data symbol streams can be multiplexed using TDMA technique, different code channels with CDMA, disjoint sets of subbands with OFDM, and so on. Each selected user terminal transmits user-specific data to and/or receives user-specific data from the access point. In general, each selected user terminal may be equipped with one or multiple antennas (i.e., $N_{ut} \geq 1$). The K selected user terminals can have the same or different number of antennas.

The SDMA system may be a time division duplex (TDD) system or a frequency division duplex (FDD) system. For a TDD system, the downlink and uplink share the same frequency band. For an FDD system, the downlink and uplink use different frequency bands. MIMO system 100 may also utilize a single carrier or multiple carriers for transmission. Each user terminal may be equipped with a single antenna (e.g., in order to keep costs down) or multiple antennas (e.g., where the additional cost can be supported). The system 100 may also be a TDMA system if the user terminals 120 share the same frequency channel by dividing transmission/reception into different time slots, each time slot being assigned to different user terminal 120.

Figure 2:
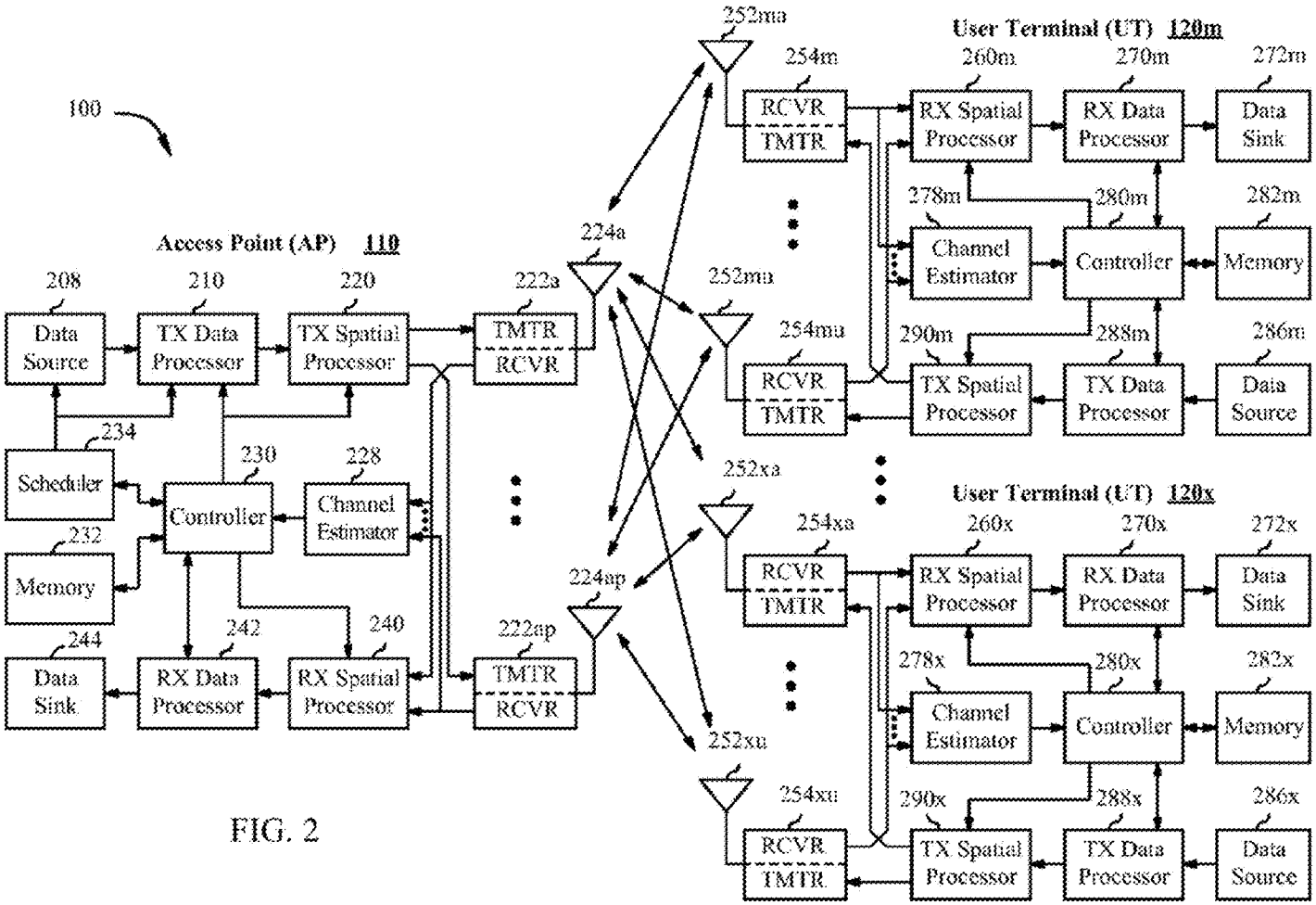
FIG. 2 illustrates a block diagram of an example access point and user terminals, in accordance with certain aspects of the present disclosure.

FIG. 2 illustrates example components of the AP 110 and UT 120 illustrated in FIG. 1, which may be used to implement aspects of the present disclosure. One or more components of the AP 110 and UT 120 may be used to practice aspects of the present disclosure. For example, antenna 224, Tx/Rx 222, processors 210, 220, 240, 242, and/or controller 230 may be used to perform the operations described herein. Similarly, antenna 252, Tx/Rx 254, processors 260, 270, 288, and 290, and/or controller 280 may be used to perform the operations described herein.

FIG. 2 illustrates a block diagram of access point 110 and two user terminals 120*m* and 120*x* in MIMO system 100. The access point 110 is equipped with $N_t$ antennas 224*a* through 224*ap*. User terminal 120*m* is equipped with $N_{ut,m}$ antennas 252*ma* through 252*mu*, and user terminal 120*x* is equipped with $N_{ut,x}$ antennas 252*xa* through 252*xu*. The access point 110 is a transmitting entity for the downlink and a receiving entity for the uplink. Each user terminal 120 is a transmitting entity for the uplink and a receiving entity for the downlink. As used herein, a "transmitting entity" is an independently operated apparatus or device capable of transmitting data via a wireless channel, and a "receiving entity" is an independently operated apparatus or device capable of receiving data via a wireless channel. In the following description, the subscript "dn" denotes the downlink, the subscript "up" denotes the uplink, $N_{up}$ user terminals are selected for simultaneous transmission on the uplink, $N_{dn}$ user terminals are selected for simultaneous transmission on the downlink, $N_{up}$ may or may not be equal to $N_{dn}$, and $N_{up}$ and $N_{dn}$ may be static values or can change for each scheduling interval. The beam-steering or some other spatial processing technique may be used at the access point and user terminal.

On the uplink, at each user terminal 120 selected for uplink transmission, a transmit (TX) data processor 288 receives traffic data from a data source 286 and control data from a controller 280. The controller 280 may be coupled with a memory 282. TX data processor 288 processes (e.g., encodes, interleaves, and modulates) the traffic data for the user terminal based on the coding and modulation schemes associated with the rate selected for the user terminal and provides a data symbol stream. A TX spatial processor 290 performs spatial processing on the data symbol stream and provides $N_{ut,m}$ transmit symbol streams for the $N_{ut,m}$ antennas. Each transmitter unit (TMTR) 254 receives and processes (e.g., converts to analog, amplifies, filters, and frequency upconverts) a respective transmit symbol stream to generate an uplink signal. $N_{ut,m}$ transmitter units 254 provide $N_{ut,m}$ uplink signals for transmission from $N_{ut,m}$ antennas 252 to the access point.

$N_{up}$ user terminals may be scheduled for simultaneous transmission on the uplink. Each of these user terminals performs spatial processing on its data symbol stream and transmits its set of transmit symbol streams on the uplink to the access point.

At access point 110, $N_{ap}$ antennas 224*a* through 224*ap* receive the uplink signals from all $N_{up}$ user terminals transmitting on the uplink. Each antenna 224 provides a received signal to a respective receiver unit (RCVR) 222. Each receiver unit 222 performs processing complementary to that performed by transmitter unit 254 and provides a received symbol stream. An RX spatial processor 240 performs receiver spatial processing on the $N_{ap}$ received symbol streams from $N_{ap}$ receiver units 222 and provides $N_{up}$ recovered uplink data symbol streams. The receiver spatial processing is performed in accordance with the channel correlation matrix inversion (CCMI), minimum mean square error (MMSE), soft interference cancellation (SIC), or some other technique. Each recovered uplink data symbol stream is an estimate of a data symbol stream transmitted by a respective user terminal. An RX data processor 242 processes (e.g., demodulates, deinterleaves, and decodes) each recovered uplink data symbol stream in accordance with the rate used for that stream to obtain decoded data. The decoded data for each user terminal may be provided to a data sink 244 for storage and/or a controller 230 for further processing. The controller 230 may be coupled with a memory 232.

On the downlink, at access point 110, a TX data processor 210 receives traffic data from a data source 208 for $N_{dn}$ user terminals scheduled for downlink transmission, control data from a controller 230, and possibly other data from a scheduler 234. The various types of data may be sent on different transport channels. TX data processor 210 processes (e.g., encodes, interleaves, and modulates) the traffic data for each user terminal based on the rate selected for that user terminal. TX data processor 210 provides $N_{dn}$ downlink data symbol streams for the $N_{dn}$ user terminals. A TX spatial processor 220 performs spatial processing (such as a precoding or beamforming, as described in the present disclosure) on the $N_{dn}$ downlink data symbol streams, and provides $N_{ap}$ transmit symbol streams for the $N_{ap}$ antennas. Each transmitter unit 222 receives and processes a respective transmit symbol stream to generate a downlink signal. $N_{ap}$ transmitter units 222 providing $N_{ap}$ downlink signals for transmission from $N_{ap}$ antennas 224 to the user terminals.

At each user terminal 120, $N_{ut,m}$ antennas 252 receive the $N_{ap}$ downlink signals from access point 110. Each receiver unit 254 processes a received signal from an associated antenna 252 and provides a received symbol stream. An RX spatial processor 260 performs receiver spatial processing on $N_{ut,m}$ received symbol streams from $N_{ut,m}$ receiver units 254 and provides a recovered downlink data symbol stream for the user terminal. The receiver spatial processing is performed in accordance with the CCMI, MMSE or some other technique. An RX data processor 270 processes (e.g., demodulates, deinterleaves and decodes) the recovered downlink data symbol stream to obtain decoded data for the user terminal. The decoded data for each user terminal may be provided to a data sink 272 for storage and/or a controller 280 for further processing.

At each user terminal 120, a channel estimator 278 estimates the downlink channel response and provides downlink channel estimates, which may include channel gain estimates, SNR estimates, noise variance and so on. Similarly, at access point 110, a channel estimator 228 estimates the uplink channel response and provides uplink channel estimates. Controller 280 for each user terminal typically derives the spatial filter matrix for the user terminal based on the downlink channel response matrix $H_{dn,m}$ for that user terminal. Controller 230 derives the spatial filter matrix for the access point based on the effective uplink channel response matrix $H_{up,eff}$. Controller 280 for each user terminal may send feedback information (e.g., the downlink and/or uplink eigenvectors, eigenvalues, SNR estimates, and so on) to the access point. Controllers 230 and 280 also control the operation of various processing units at access point 110 and user terminal 120, respectively.

Figure 3:
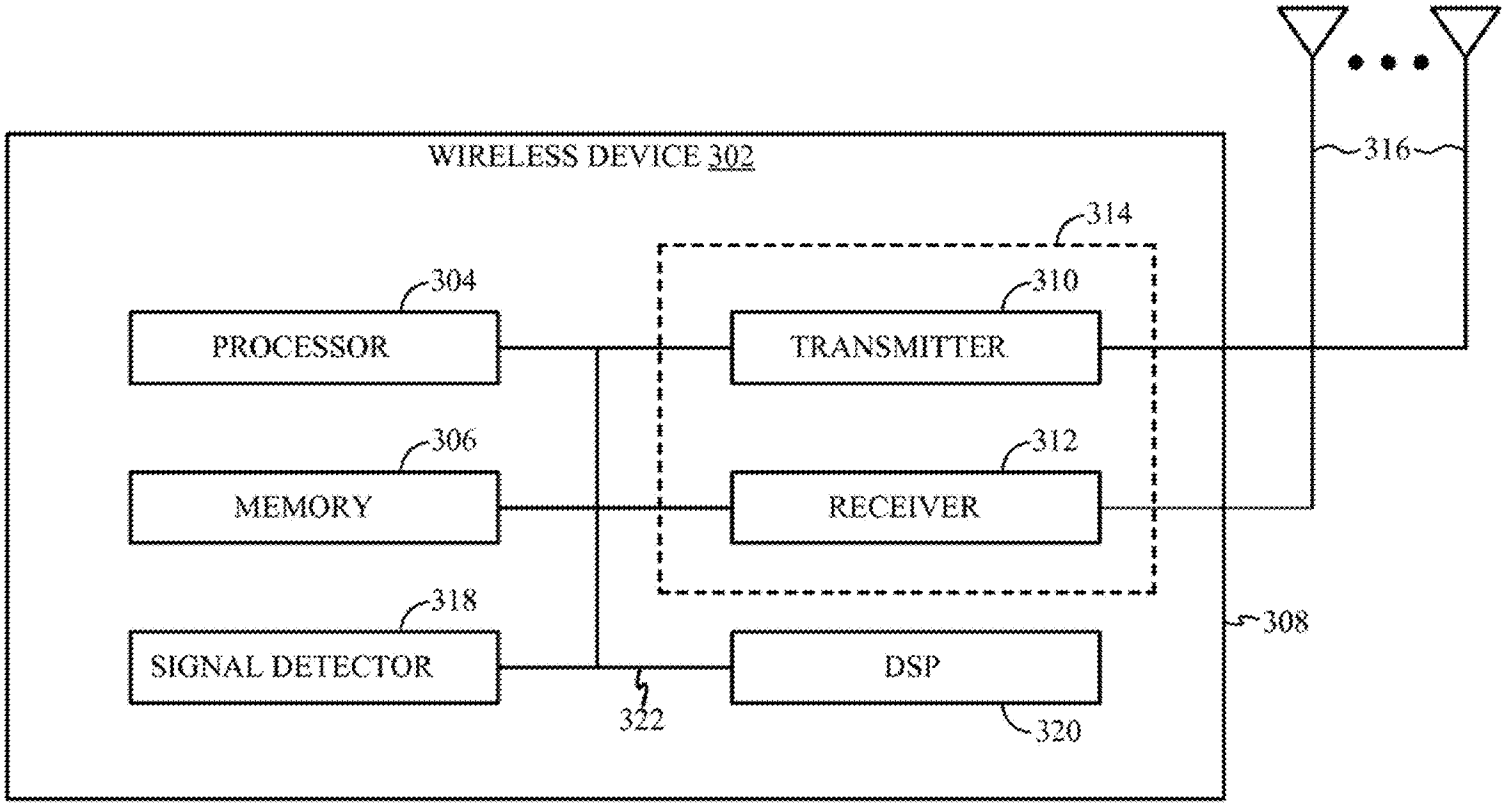
FIG. 3 illustrates a block diagram of an example wireless device, in accordance with certain aspects of the present disclosure.

FIG. 3 illustrates example components that may be utilized in the AP 110 and/or UT 120 to implement aspects of the present disclosure. For example, the transmitter 310, antenna(s) 316, processor 304 and/or the DSP 320 may be used to practice aspects of the present disclosure implemented by the AP. Further, the receiver 312, antenna(s) 316, processor 304 and/or the DSP 320 may be used to practice aspects of the present disclosure implemented by the UT.

FIG. 3 illustrates various components that may be utilized in a wireless device 302 that may be employed within the MIMO system 100. The wireless device 302 is an example of a device that may be configured to implement the various methods described herein. The wireless device 302 may be an access point 110 or a user terminal 120.

The wireless device 302 may include a processor 304 which controls operation of the wireless device 302. The processor 304 may also be referred to as a central processing unit (CPU). Memory 306, which may include both read-only memory (ROM) and random access memory (RAM), provides instructions and data to the processor 304. A portion of the memory 306 may also include non-volatile random access memory (NVRAM). The processor 304 typically performs logical and arithmetic operations based on program instructions stored within the memory 306. The instructions in the memory 306 may be executable to implement the methods described herein.

The wireless device 302 may also include a housing 308 that may include a transmitter 310 and a receiver 312 to allow transmission and reception of data between the wireless device 302 and a remote node. The transmitter 310 and receiver 312 may be combined into a transceiver 314. A single or a plurality of transmit antennas 316 may be attached to the housing 308 and electrically coupled to the transceiver 314. The wireless device 302 may also include (not shown) multiple transmitters, multiple receivers, and multiple transceivers.

The wireless device 302 may also include a signal detector 318 that may be used in an effort to detect and quantify the level of signals received by the transceiver 314. The signal detector 318 may detect such signals as total energy, energy per subcarrier per symbol, power spectral density and other signals. The wireless device 302 may also include a digital signal processor (DSP) 320 for use in processing signals.

The various components of the wireless device 302 may be coupled together by a bus system 322, which may include a power bus, a control signal bus, and a status signal bus in addition to a data bus.

Antenna Design

Figure 4A:
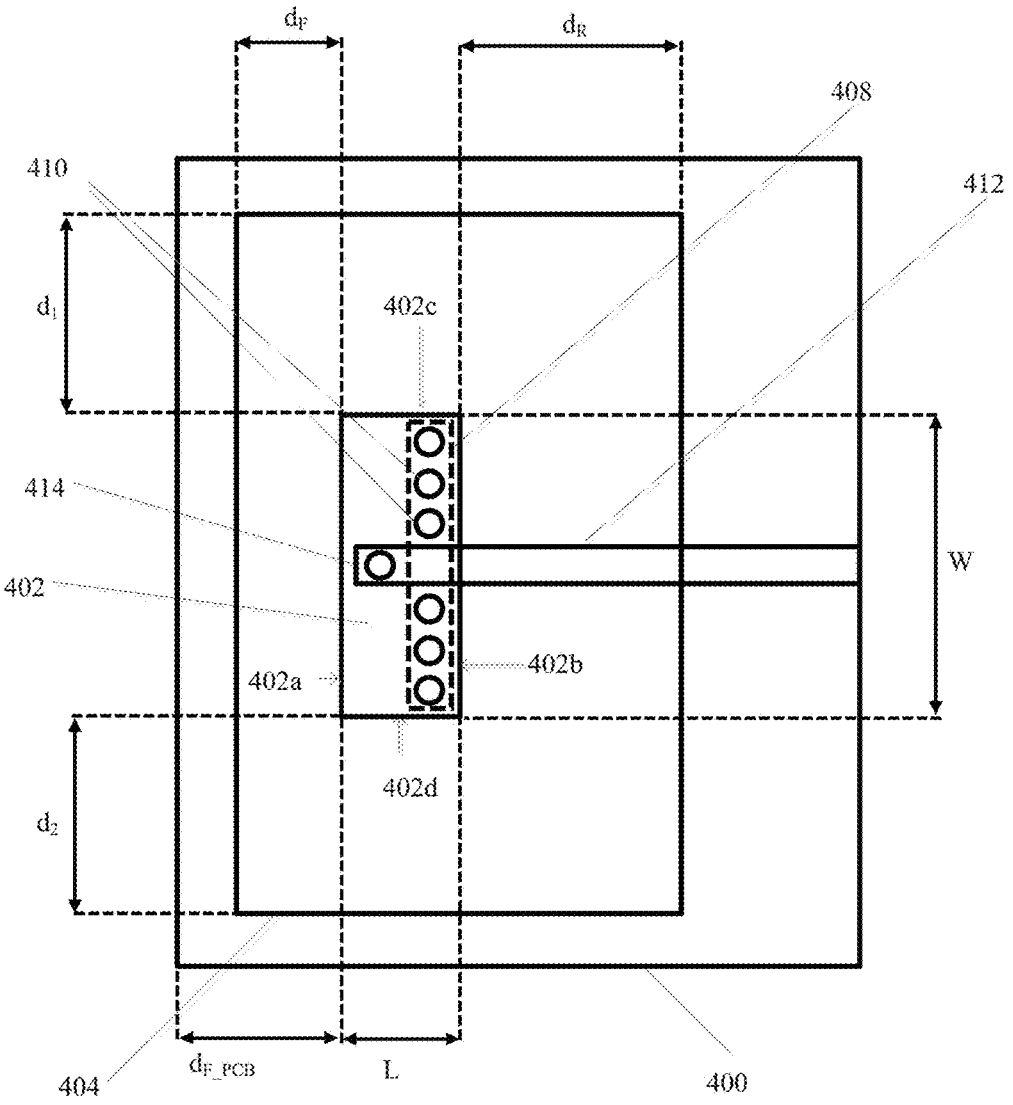
FIGS. 4A and 4B shows top and cross-section side views, respectively, of a PCB including patch antenna according to an aspect of the present disclosure.
Figure 4B:
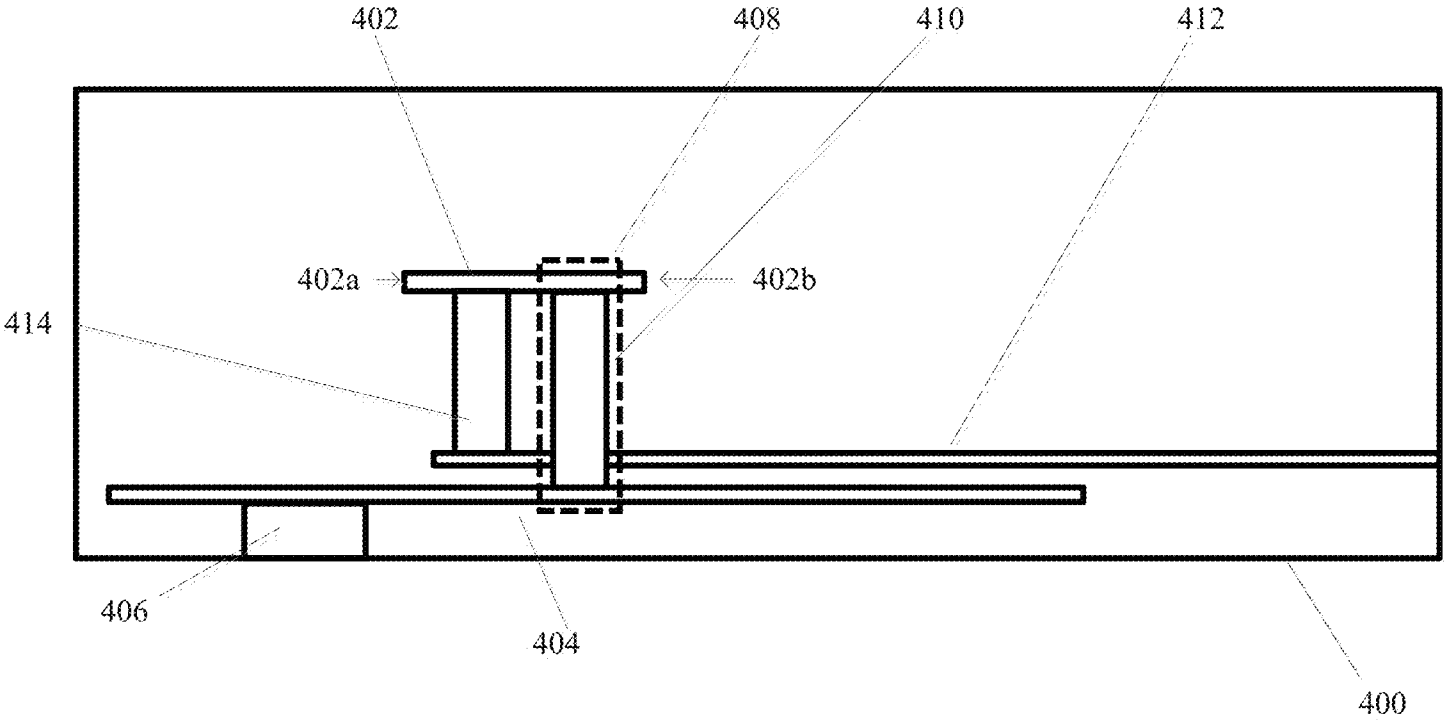

To provide a better foundation for understanding the various aspects of the present disclosure, reference is now made to FIGS. 4A and 4B which illustrate an implementation of a patch antenna according to an aspect of the present disclosure.

FIGS. 4A and 4B, show top and cross-section side views, respectively, of a PCB 400 that provides a substrate for supporting a shorted half patch antenna according to an aspect of the present disclosure. As shown in FIGS. 4A and 4B, the PCB 400 includes a radiating element 402 with a front edge or end 402*a* and a rear end or edge 402*b*, a grounding element 404 coupled to a ground connection 406. The PCB 400 also includes at least one shorting element 408 for coupling a portion of the radiating element 404 adjacent to the rear edge 402*b* of the radiating element 402 to the grounding element 404. For example, in some aspects, the at least one shorting element 408 can be a plurality of vias 410 formed in the PCB 400 from conductive materials and extending vertically from the grounding element 404 up to the radiating element 402 through a dielectric material of the PCB. Further, the front edge 402*a* of the radiating element 402 is positioned close to an edge of the grounding element 404 but far from other edges of the grounding element 404, as discussed in further detail below.

The PCB 400 further includes feed structure for coupling the radiating element 402 to a processing system or other component. In particular, the feed structure includes at least one feed line 412 and a feed via 414, where the feed line 412 is coupled to the radiating element 402 using the feed via 414. For example, in some aspects, the feed line 412 may include at least one microstrip line in the PCB 400 and, if needed, one or more vias formed in the PCB 400 to electrically couple the feed via 414 to the processing system via the various layers of the PCB 400. The feed via 414 can also be a via formed in the PCB 400 and may be configured to extend vertically between the radiating element 404 and the feed line 412.

The elements 402, 404, 406, 408, 410, 412, and 414 can be formed in a PCB using any techniques for forming vias, lines, traces, etc. in a PCB technology. However, the present disclosure contemplates the use of non-PCB technologies. In the case of non-PCB technologies, such features can be formed using corresponding techniques.

In PCB 400, the arrangement of the radiating element 402, the at least one shorting element 408, and the grounding element 404 are configured to provide a shorted half patch antenna. A patch antenna configuration has the advantage of being able to be deployed in various types of PCBs and similar technologies, such as integrated circuit packages, while the dipole antennas would require special clearance requirements. For example, patch antennas can be placed directly over metal layers, solder balls or other features of the PCB. Second, a patch antenna configuration also supports offers polarization diversity, which is important for the 60 GHz band, since the antennas used for 60 GHz typically have low cross polarization and the mobile side of a connection can have a random orientation. Thus, patch antennas can be deployed in different parts of the package to provide polarization diversity.

In a standard patch antenna, an antenna is configured to have a radiating element coupled to a feed line and placed parallel to a grounding element. In this configuration, the standard patch antenna behaves like two slot antennas that are approximately a half wave apart. However, this also creates a two element array that has a peak gain orthogonal to the plane of the patch (i.e., at higher angles) and lower gain at the low angles, where the two slots destructively interfere. Additionally, the presence of a ground plane surrounding the patch further limits the radiation at low angles. In contrast, a shorted half patch antenna is configured to have a radiating element coupled not only to the feed line, but also to the ground plane, which causes the half patch antenna to have only one slot. This removes the destructive interference typically encountered in a standard patch antenna at low angles. Thus, this also improves support for polarization diversity at low angles.

A shorted half patch antenna design is characterized in that a rear edge or end of the radiating element is coupled to a grounding element and that a length of a radiating element is selected to be one quarter of a wavelength within the dielectric medium for a center frequency of operation. In PCB 400, a shorted half wave patch antenna configuration is provided by configuring the radiating element 402 to have the rear edge 402*b* coupled to the grounding element 404 using the at least one shorting element 408. The shorting element 408 can be formed using a plurality of vias 410 contacting a. Further, the length L of radiating element 402 is selected to be one quarter of a wavelength (λ/4) for the dielectric material constituting PCB 400 for the center frequency for a radio band of operation (e.g., 60 GHz radio band). The radiating element 402 is also selected to have a width W. The width W and the placement of feed via 414 are selected so as to provide the impedance and tuning needed for a particular application.

Although radiating element 402 and grounding element 404 are illustrated herein as having rectangular shapes, this is only for ease of illustration. The present disclosure contemplates that the techniques described herein can be utilized with elements of different shapes.

Further, although vias 410, 414, and others discussed above and below are shown as single cylindrical vias, this is solely for ease of illustration. The present disclosure contemplates that vias of any shape or dimensions can be used to form the half shorted patch antennas described herein. For example, the shorted wall 408 can be formed using one or two wide via structures instead of the series of vias 410 illustrated in FIGS. 4A and 4B. Thus, the only requirement for the at least one shorting element 408 is that the shorting elements, whether vias 410 or other elements, extend along a substantial portion of the rear edge 402*b*. For example, at least 40%.

The present disclosure contemplates that an improvement on standard shorted half patch antennas by careful selection of the position of the edges of the radiating element relative to the edges of the ground elements. This improvement results in enhanced forward or low angle radiation, as discussed below.

As noted above, one aspect of the shorted half patch antenna formed in PCB 400 is that the front edge 402*a* of the radiating element 402 is positioned close to an edge of the grounding element 404. In particular, the radiating element 402 is positioned relative to the grounding element so that a lateral distance $d_F$ from the front edge 402*a* to a corresponding edge of the grounding element 404 is less than or equal to one half of the wavelength (λ/2) for the center frequency for the radio band of operation. In particular implementations, this distance can be zero ($d_F$=0). Placing the radiating element 402 with respect to the grounding element 404 in this manner thus reduces that the amount of ground plane that would attenuate the forward direction, low angle radiated signals. In some implementations, this effect can be further improved by placing the forward edge 102*a* as close as possible to an outer edge of the PCB 400 itself, i.e., reduce $d_{F_PCB}$ as much as possible. In particular implementations, this distance can be zero ($d_{F_PCB}$=0).

As further noted above, one aspect of the shorted half patch antenna formed in PCB 400 is that the other edges of the radiating element 402 are positioned to be far from the edges of the grounding element 404. In particular, the radiating element 402 is positioned relative to the grounding element so that a lateral distance $d_R$ from the rear edge 402*b* to a corresponding edge of the grounding element 404 is greater than or equal to one half of the wavelength (λ/2) for the center frequency for the radio band of operation. Similarly, the radiating element 402 is positioned relative to the grounding element 404 so that a lateral distances $d_1$ and $d_2$ from side edges 402*c* and 402*d*, respectively, of the radiating element 402 to the corresponding edges of the grounding element 404 are each greater than or equal to one half of the wavelength (λ/2) for the center frequency of operation. Such a configuration for edges 402*b*, 402*c*, and 402*d* thus reduces the amount of attenuation for signals radiated in other directions due to the increased ground plane area for these edges versus the front edge 402*a*, thus favoring forward (i.e., low angle) performance.

Figure 5:
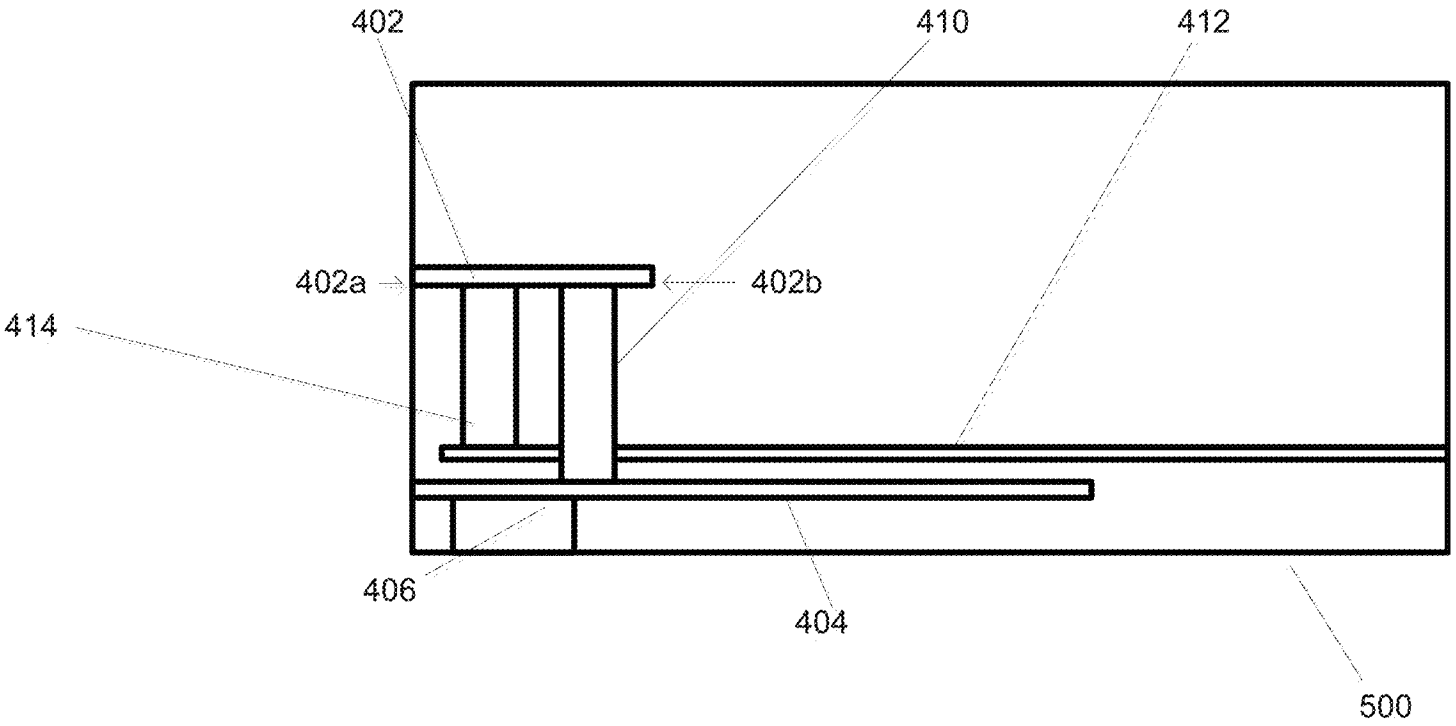
FIG. 5 shows a PCB including a patch antenna configured according to a first alternative aspect of the present disclosure.

The configuration of FIGS. 4A and 4B can be modified in a variety of ways to further improve performance. One such modification is illustrated in FIG. 5, which shows a PCB 500 including a shorted half patch antenna configured according to a first alternative aspect of the present disclosure. As noted above, one possible implementation is to arrange the radiating element 402 and the grounding element 404 so that $d_F$=0 and so that $d_{F_PCB}$=0. Such a configuration is illustrated by PCB 500 in FIG. 5. As discussed above, this configuration results in an overall reduction of attenuation of forward (i.e., low angle) signals radiating from the radiating element 402.

Figure 6:
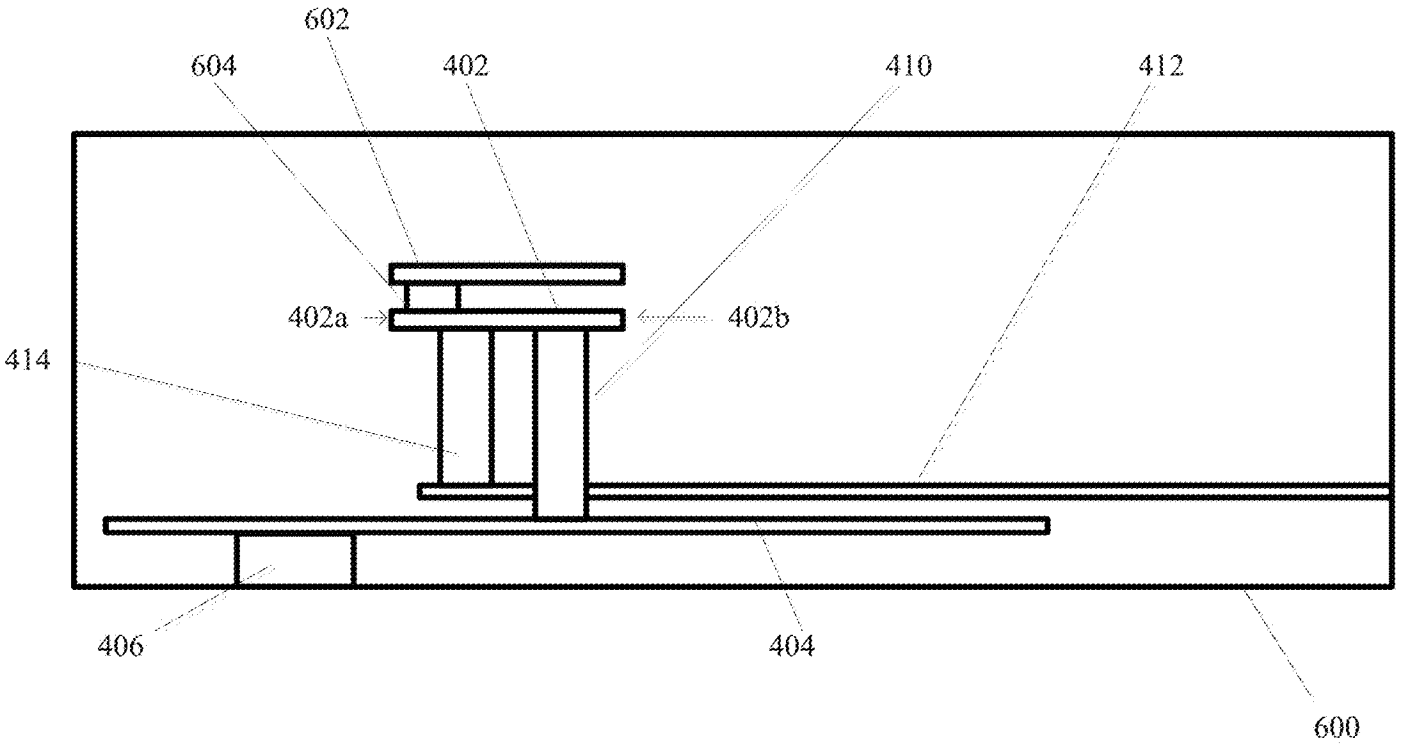
FIG. 6 shows a PCB including a patch antenna configured according to a first alternative aspect of the present disclosure.

Another potential modification is illustrated in FIG. 6, which shows a PCB 600 including a patch antenna configured according to a second alternative aspect of the present disclosure. As shown in FIG. 6, PCB 600 is configured substantially the same as PCB 400 in FIGS. 4A and 4B. However, in addition to the features described above with respect to PCB 400, PCB 600 includes a second radiating element 602 positioned above the radiating element 402 and coupled to a front end 402*a* of radiating element 402 using a coupling structure. For example, as shown in FIG. 6, one or more vias 604 formed in the PCB 600 can provide such a coupling structure. The second radiating element 602 can be dimensioned substantially the same as radiating element 402. Further, the second radiating element 602 can be positioned so that second radiating element 602 and the radiating element 402 are substantially in complete overlap with each other. This configuration results in an additional resonator being provided for the antenna. Such a configuration can be utilized to improve impedance bandwidth performance of the resulting shorted half patch antenna. In particular, this configuration can be utilized to provide a wider bandwidth.

Figure 7:
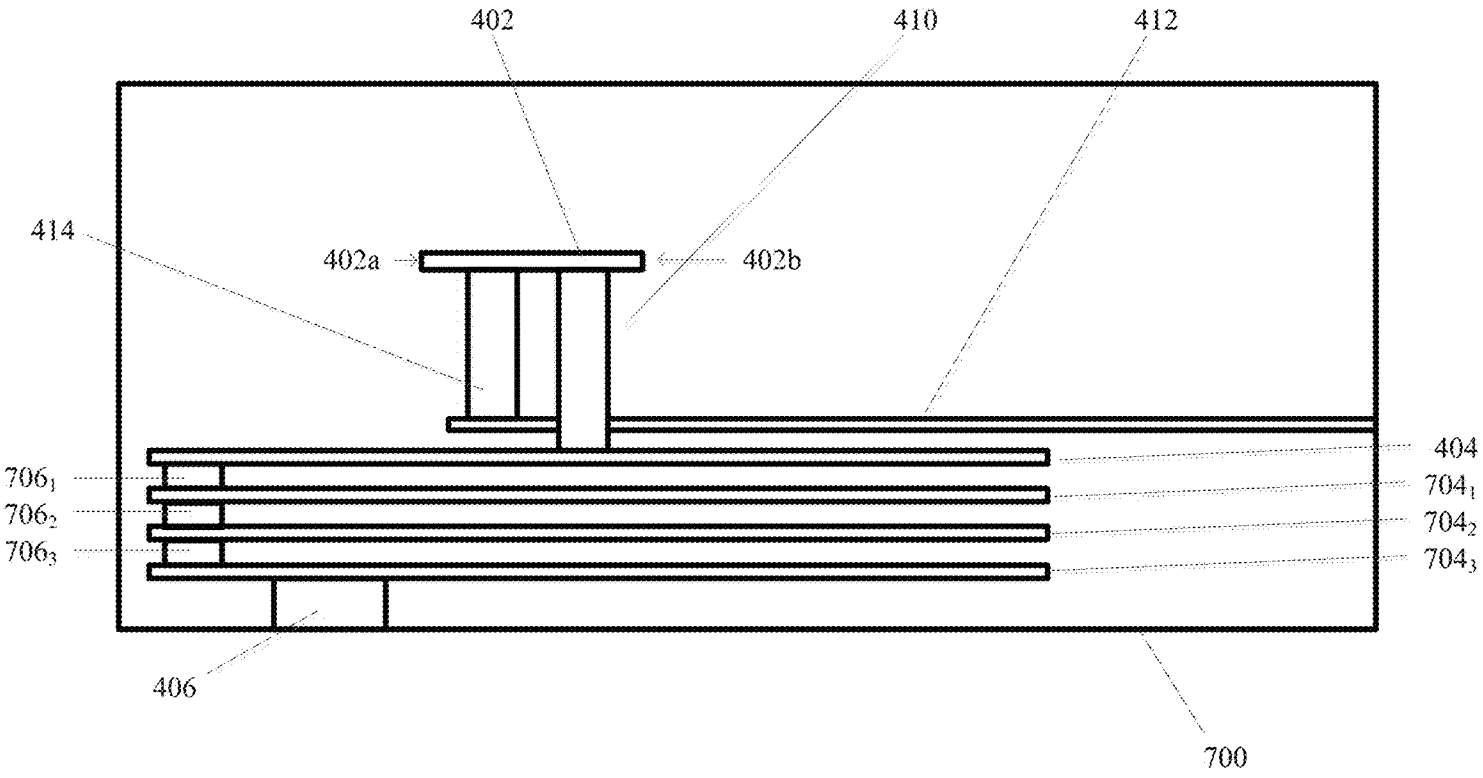
FIG. 7 shows a PCB including a patch antenna configured according to a first alternative aspect of the present disclosure.

Another modification is illustrated in FIG. 7, which shows a PCB 700 including a patch antenna configured according to a third alternative aspect of the present disclosure. As shown in FIG. 7, PCB 700 is configured substantially the same as PCB 400 in FIGS. 4A and 4B. However, in addition to the features described above with respect to PCB 400, PCB 700 also includes additional grounding elements $\mathbf{704}_1$, $\mathbf{704}_2$, $\mathbf{704}_3$ coupled to grounding element 404 and each other using a coupling structure. For example as shown in FIG. 7, a coupling structure may be provided in PCB 700 by vias $\mathbf{706}_1$, $\mathbf{706}_2$, and $\mathbf{706}_3$.

This results in a larger ground plane that can reduce electrical noise and interference through ground loops and to prevent crosstalk between adjacent circuit traces. In particular, when large current pulses occur in response to switching of states in a circuit and the power supply and ground traces have significant impedances, the voltage drop across these traces can create noise voltage pulses. However, by providing a large conducting area, and thus lower impedances, the amount of noise due to current pulses can be substantially reduced in PCB 700. Moreover, in a high density PCB, the antenna layers will usually need to be located above other routing and other supply layers. Accordingly, the multiple grounding elements for FIG. 7 permit the antenna elements to be better isolated from such layers, thus ensuring more reliable operation of the antenna.

It should be noted that although the modifications of FIGS. 5-7 are illustrated in isolation, this is solely for ease of illustration. Rather, the present disclosure contemplates that modifications discussed above can be used in any combination with each other.

Figure 8:
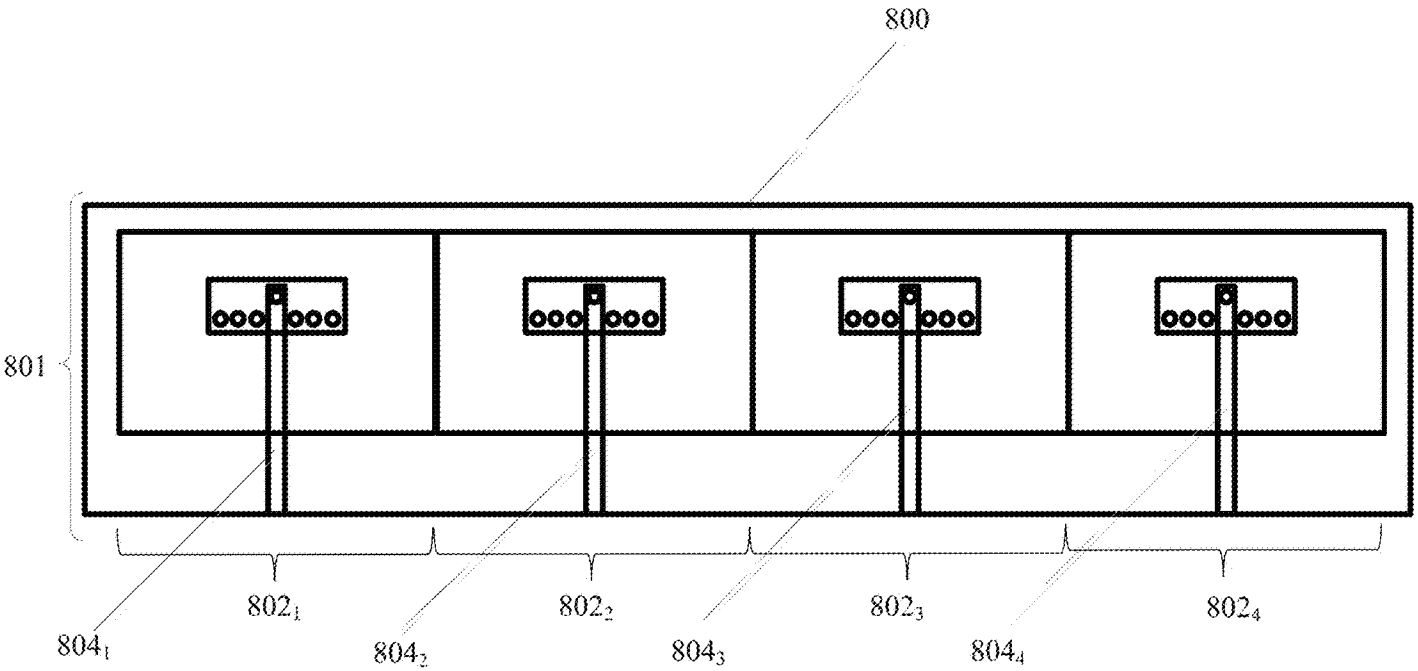
FIG. 8 shows a PCB including an array of patch antennas configured according to an aspect of the present disclosure.

Further, although the foregoing discussion has been primarily directed to a description of the configuration of single shorted half plane antennas, the present disclosure contemplates using multiple instances of such antennas in unison. For example, in the case of 60 GHz band communications, it is desirable to utilize a plurality of antennas, combined with amplitude and phase control signals being fed therein, to provide a beamformer for focusing and directing signals in a desired direction. One such implementation is illustrated in FIG. 8, which shows an array of shorted half plane antennas in accordance with an aspect of the present disclosure. As shown in FIG. 8, a PCB 800 is provided showing an array 801 of antennas $\mathbf{802}_a$, $\mathbf{802}_b$, $\mathbf{802}_c$, and $\mathbf{802}_d$. Each of antennas 802*i* can be configured, for example, in accordance with any of FIGS. 4A-7, or any variations or combinations thereof. In operation, the signals at each of feed lines $\mathbf{804}_a$, $\mathbf{804}_b$, $\mathbf{804}_c$, and $\mathbf{804}_d$ can be adjusted in phase and/or amplitude via a control circuit (not shown) for all or each of the feed lines $\mathbf{804}_a$, $\mathbf{804}_b$, $\mathbf{804}_c$, and $\mathbf{804}_d$. As a result, the array 801 operates a beam former to direct signals in a particular direction. Further, as each of antennas has improved forward (i.e., low angle) performance, the coverage provided by array 801 is significantly wider than possible using standard patch antennas or even existing shorted half wave antennas.

Figure 9:
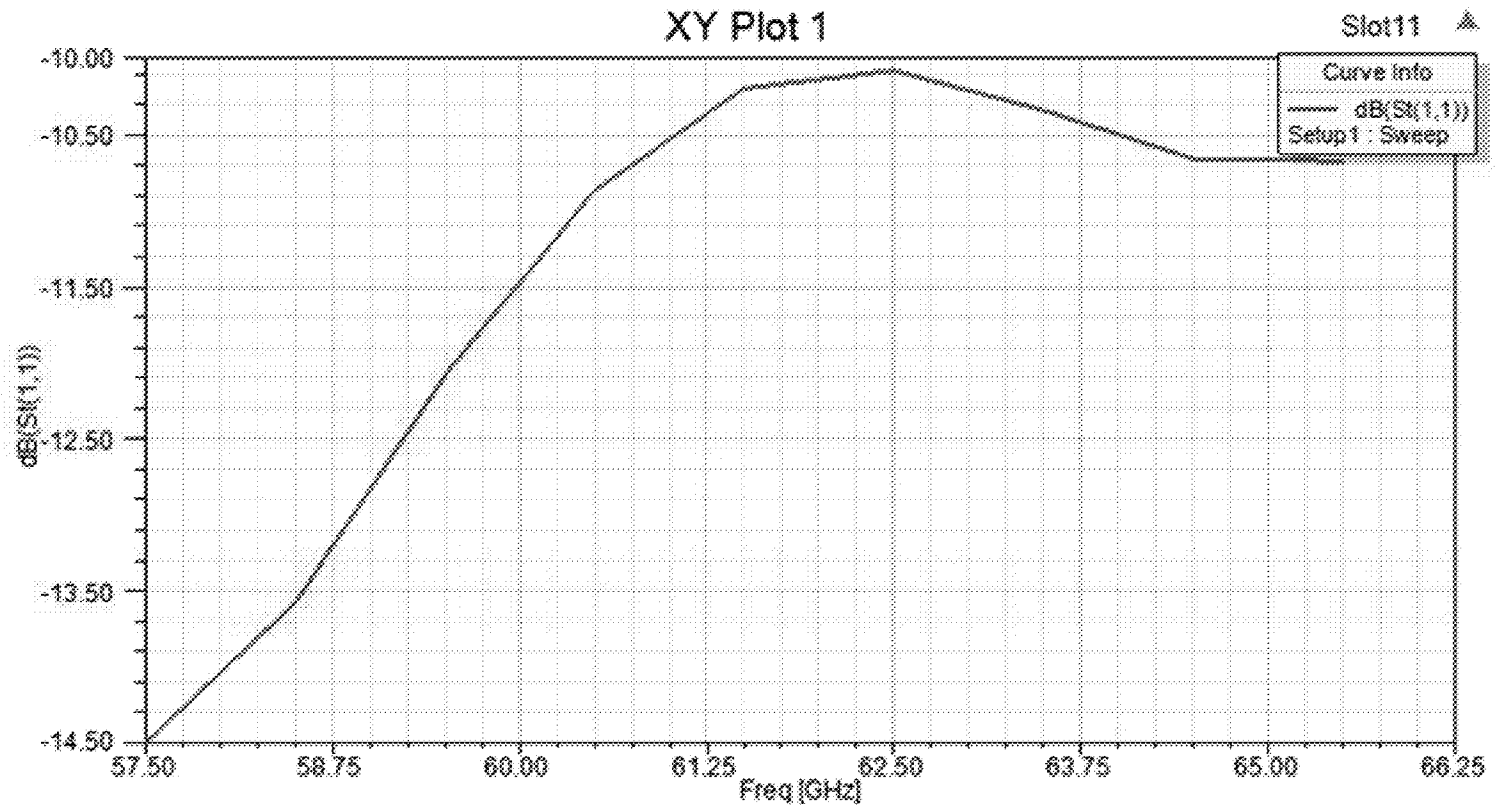
FIG. 9 shows an X-Y plot of return loss over a 60 GHz band for a patch antenna according to an aspect of the present disclosure.
Figure 10:
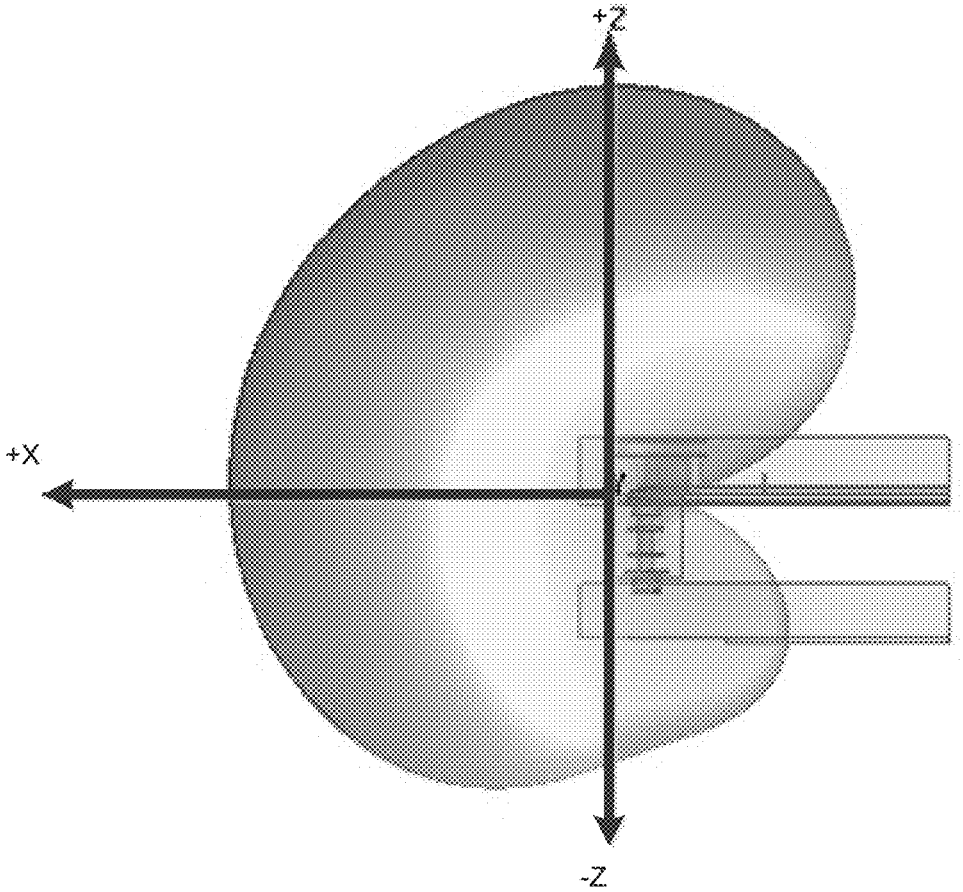
FIG. 10 shows a radiation pattern for a patch antenna according to an aspect of the present disclosure.

Turning now to FIGS. 9 and 10, the performance of shorted half patch antennas according to aspects of the present disclosure is presented. For each of FIGS. 9 and 10, the operation in free space for a patch antenna combining aspects of the shorted half patch antennas of FIGS. 6 and 7 was simulated. That is, a shorted half patch antenna, as described in FIGS. 4A and 4B, but with the addition of a second radiating element, as described with respect to FIG. 6, and the addition of additional grounding elements $\mathbf{704}_1$, $\mathbf{704}_2$, $\mathbf{704}_3$, as described with respect to FIG. 7.

FIG. 9 shows an X-Y plot of return loss as a function of frequency over a 60 GHz band (57.5 GHz to 66.25 GHz) for the above-described shorted half patch antenna. As shown in FIG. 9, the return loss throughout the range is between −10 dB and −14.5 dB, meaning that less than 1/10th of the RF energy is being reflected. Typically, a return loss of −10 dB or less is typically considered good when the devices under test are considered to be tuned and have a reasonably good impedance matching. Thus, FIG. 9 illustrates that the shorted half patch antenna of the present disclosure provides acceptable return loss.

FIG. 10 shows a radiation pattern for this same shorted half patch antenna mounted on a package. As can be observed from FIG. 10, the new shorted half patch antenna design results in substantially a same radiation pattern for high angles (+Z direction) as for low angles (+X direction). Some attenuation is observed for some high angles (−Z direction), but this is due to the package. However, FIG. 10 does show that attenuation typically observed for low angles in patch antennas is reduced or eliminated in the new shorted half patch antenna design described above.

The various operations of methods described above may be performed by any suitable means capable of performing the corresponding functions. The means may include various hardware and/or software component(s) and/or module(s), including, but not limited to a circuit, an application specific integrated circuit (ASIC), or processor. Generally, where there are operations illustrated in figures, those operations may have corresponding counterpart means-plus-function components with similar numbering.

Means for generating may include a processing system, which may include one or more processors, such as the processors 210, 242, and/or the controller 230 of the access point 110 illustrated in FIG. 2 or the processor 304 and/or the DSP 320 portrayed in FIG. 3. The means for outputting (e.g., transmitting) may comprise a transmitter (e.g., the transmitter unit 222) and/or an antenna(s) 224 of the access point 110 illustrated in FIG. 2 or the transmitter 310 and/or antenna(s) 316 depicted in FIG. 3.

Means for obtaining (e.g., receiving) may comprise a receiver (e.g., the receiver unit 254) and/or an antenna(s) 252 of the UT 120 illustrated in FIG. 2 or the receiver 312 and/or antenna(s) 316 depicted in FIG. 3. Means for determining may include a processing system, which may include one or more processors such as processors 260, 270, 288, and 290 and/or the controller 280 of the UT 120 or the processor 304 and/or the DSP 320 portrayed in FIG. 3.

Means for feeding may comprise the feed structure for coupling the radiating element 402 to a processing system or other component, as discussed above with respect to FIG. 4. In particular, means for feeding may comprise at least one feed line 412 and a feed via 414 as discussed above with respect to FIG. 4. Means for coupling the grounding element 404 to the radiating element 402 may comprise vias 410 in FIG. 4 or any combination of vias and microstrip lines in PCB 400 for coupling the grounding element 404 to the radiating element 402. Means for coupling the second radiating element 602 to the first radiating element 404 may comprise vias 604, as shown in FIG. 6, or any combination of vias and microstrip lines in PCB 600. Means for coupling the grounding element 404 and the at least one second grounding element 706*i* may comprise vias 704*i*, as shown in FIG. 7, or any combination of vias and microstrip lines in PCB 700.

According to certain aspects, such means may be implemented by processing systems configured to perform the corresponding functions by implementing various algorithms (e.g., in hardware or by executing software instructions) described above.

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Furthermore, "determining" may include resolving, selecting, choosing, establishing and the like.

As used herein, the term "outputting" may involve actual transmission or output of a structure from one entity (e.g., a processing system) to another entity (e.g., an RF front end or modem) for transmission. As used herein, the term "obtaining" may involve actual receiving of a structure transmitted over the air or obtaining the structure by one entity (e.g., a processing system) from another entity (e.g., an RF front end or modem).

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The various illustrative logical blocks, modules and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the present disclosure may be embodied directly in hardware, in a software module executed by a processor, or in a combination of the two. A software module may reside in any form of storage medium that is known in the art. Some examples of storage media that may be used include random access memory (RAM), read only memory (ROM), flash memory, EPROM memory, EEPROM memory, registers, a hard disk, a removable disk, a CD-ROM and so forth. A software module may comprise a single instruction, or many instructions, and may be distributed over several different code segments, among different programs, and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in hardware, an example hardware configuration may comprise a processing system in a wireless node. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to couple a network adapter, among other things, to the processing system via the bus. The network adapter may be used to implement the signal processing functions of the Physical (PHY) layer. In the case of a user terminal 120 (see FIG. 1), a user interface (e.g., keypad, display, mouse, joystick, etc.) may also be coupled to the bus. The bus may also link various other circuits such as timing sources, peripherals, voltage regulators, power management circuits, and the like, which are well known in the art, and therefore, will not be described any further.

The processor may be responsible for managing the bus and general processing, including the execution of software stored on the machine-readable media. The processor may be implemented with one or more general-purpose and/or special-purpose processors. Examples include microprocessors, microcontrollers, DSP processors, and other circuitry that can execute software. Software shall be construed broadly to mean instructions, data, or any combination thereof, whether referred to as software, firmware, middleware, microcode, hardware description language, or otherwise. Machine-readable media may include, by way of example, RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The machine-readable media may comprise a computer-readable medium having instructions stored (and/or encoded) thereon, the instructions being executable by one or more processors to perform the operations described herein and be embodied in a computer-program product. The computer-program product may comprise packaging materials to advertise the computer-readable medium therein for purchase by consumers.

In a hardware implementation, the machine-readable media may be part of the processing system separate from the processor. However, as those skilled in the art will readily appreciate, the machine-readable media, or any portion thereof, may be external to the processing system. By way of example, the machine-readable media may include a transmission line, a carrier wave modulated by data, and/or a computer readable storage medium with instructions stored thereon separate from the wireless node, all of which may be accessed by the processor through the bus interface. Alternatively, or in addition, the machine-readable media, or any portion thereof, may be integrated into the processor, such as the case may be with cache and/or general register files.

The processing system may be configured as a general-purpose processing system with one or more microprocessors providing the processor functionality and external memory providing at least a portion of the machine-readable media, all linked together with other supporting circuitry through an external bus architecture. Alternatively, the processing system may be implemented with an ASIC (Application Specific Integrated Circuit) with the processor, the bus interface, the user interface in the case of an access terminal), supporting circuitry, and at least a portion of the machine-readable media integrated into a single chip, or with one or more FPGAs (Field Programmable Gate Arrays), PLDs (Programmable Logic Devices), controllers, state machines, gated logic, discrete hardware components, or any other suitable circuitry, or any combination of circuits that can perform the various functionality described throughout this disclosure. Those skilled in the art will recognize how best to implement the described functionality for the processing system depending on the particular application and the overall design constraints imposed on the overall system.

The machine-readable media may comprise a number of software modules. The software modules include instructions that, when executed by an apparatus such as a processor, cause the processing system to perform various functions. The software modules may include a transmission module and a receiving module. Each software module may reside in a single storage device or be distributed across multiple storage devices. By way of example, a software module may be loaded into RAM from a hard drive when a triggering event occurs. During execution of the software module, the processor may load some of the instructions into cache to increase access speed. One or more cache lines may then be loaded into a general register file for execution by the processor. When referring to the functionality of a software module below, it will be understood that such functionality is implemented by the processor when executing instructions from that software module.

If implemented in software, the functions may be stored or transmitted over as one or more instructions or code on a computer-readable medium. Computer-readable media include both computer storage media and communication media including any medium that facilitates transfer of a computer program from one place to another. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared (IR), radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray® disc where disks usually reproduce data magnetically, while discs reproduce data optically with lasers. Thus, in some aspects computer-readable media may comprise non-transitory computer-readable media (e.g., tangible media). In addition, for other aspects computer-readable media may comprise transitory computer-readable media (e.g., a signal). Combinations of the above should also be included within the scope of computer-readable media.

Further, it should be appreciated that modules and/or other appropriate means for performing the methods and techniques described herein can be downloaded and/or otherwise obtained by a user terminal and/or base station as applicable. For example, such a device can be coupled to a server to facilitate the transfer of means for performing the methods described herein. Alternatively, various methods described herein can be provided via storage means (e.g., RAM, ROM, a physical storage medium such as a compact disc (CD) or floppy disk, etc.), such that a user terminal and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. An apparatus for wireless communications comprising:

a grounding element;

a first radiating element above the grounding element and having opposing front and rear edges;

a second radiating element positioned substantially parallel to and above the first radiating element;

at least one coupling element coupling the front edge of the first radiating element to the second radiating element; and at least one shorting element coupling the grounding element to a portion of the first radiating element adjacent to the rear edge of the first radiating element, wherein a length of the first radiating element from the front edge to the rear edge is equal to approximately one quarter of a wavelength for a frequency within a radio band for operating the apparatus, wherein a lateral distance from the front edge of the first radiating element to a corresponding edge of the grounding element is less than or equal to approximately one half of the wavelength, wherein a lateral distance from the rear edge of the first radiating element to a corresponding edge of the grounding element is greater than or equal to approximately one half of the wavelength, and wherein the at least one coupling element is disposed between the second radiating element and a portion of the first radiating element adjacent to the front edge of the first radiating element.

2. The apparatus of claim 1, wherein the first radiating element further having opposing side edges, and wherein a lateral distance from the each of the side edges of the first radiating element to a corresponding edge of the grounding element is greater than or equal to approximately one half of the wavelength.

3. The wireless apparatus of claim 1, wherein the lateral distance from the front edge of the first radiating element to the corresponding edge the grounding element is approximately zero.

4. The apparatus of claim 1, further comprising:

at least one second grounding element positioned substantially parallel to and below the grounding element; and at least one coupling element coupling the grounding element and the at least one second grounding element.

5. The apparatus of claim 1, wherein the at least one shorting element comprises a plurality of vias contacting a substantial portion of the first radiating element along the rear edge.

6. The apparatus of claim 1, further comprising a substrate configured to support the radiating element and the grounding element, and wherein a lateral distance from the front edge of the first radiating element to a corresponding edge of the grounding element and a lateral distance from the front edge of the first radiating element to a corresponding edge of the substrate are approximately the same.

7. The apparatus of claim 1, wherein the at least one coupling element comprises at least one via.

8. The apparatus of claim 1, wherein the front edge of the first radiating element is aligned with a corresponding front edge of the second radiating element, and wherein the rear edge of the first radiating element is aligned with a corresponding rear edge of the second radiating element.

* * * * *